United States Patent [19]

Stroucken

[11] 4,081,129

[45] Mar. 28, 1978

[54] CENTRIFUGE WITH PERIPHERAL OUTLETS AND STATIONARY PARING DEVICE

[75] Inventor: Klaus H. D. Stroucken, Ronninge, Sweden

[73] Assignee: Alfa-Laval AB, Tumba, Sweden

[21] Appl. No.: 718,388

[22] Filed: Aug. 27, 1976

[30] Foreign Application Priority Data

Aug. 17, 1975 Sweden ..... 75103861

[51] Int. Cl.[2] ..... B04B 1/14; B04B 15/08

[52] U.S. Cl. ..... 233/20 R

[58] Field of Search ..... 233/1 R, 1 A, 20 R, 233/20 A, 27, 29

[56] References Cited

U.S. PATENT DOCUMENTS 3,930,609 1/1976 Nelson ..... 233/20 A

FOREIGN PATENT DOCUMENTS 2,147,701 7/1972 Germany ..... 233/20 A 2,220,718 1/1973 Germany ..... 233/20 A

*Primary Examiner*—George H. Krizmanich

*Attorney, Agent, or Firm*—Cyrus S. Hapgood

[57] ABSTRACT

In a centrifuge rotor having intermittently opening peripheral outlets for discharging separated solids and having a paring chamber with stationary paring means for discharging separated liquid, an arrangement is provided to prevent air from passing into the paring channel when opening of the peripheral outlets causes the liquid level to move radially outward in the rotor. The arrangement includes an annular partition of the rotor which allows liquid flow from its separating chamber to its paring chamber during normal operation but which prevents some liquid in the paring chamber from returning to the separating chamber due to opening of the peripheral outlets, and first and second stationary annular discs coaxial with the rotor and operable while the peripheral outlets are opened to maintain, respectively, a first liquid seal between the separating chamber and the paring channel and a second liquid seal between the paring channel and the atmosphere surrounding the rotor.

7 Claims, 3 Drawing Figures

CENTRIFUGE WITH PERIPHERAL OUTLETS AND STATIONARY PARING DEVICE

Figure 1:
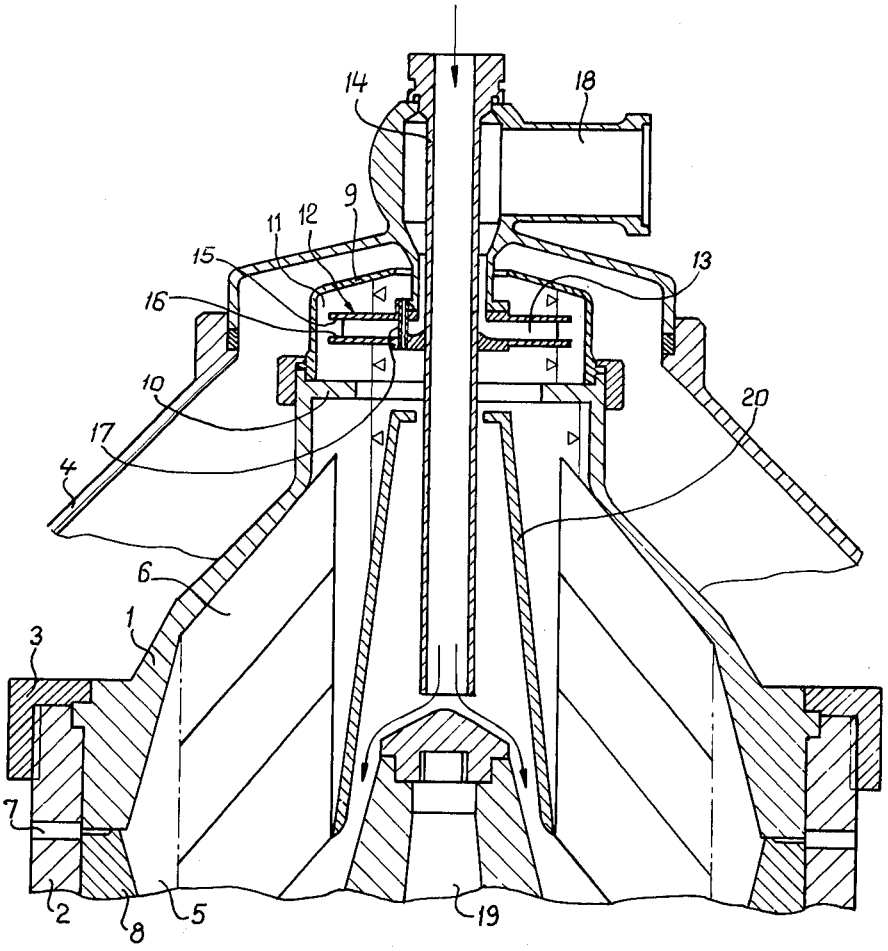

The present invention relates to centrifugal separators of the type comprising a rotor having a central inlet for a mixture to be centrifuged and having outlets at the periphery of the separating chamber which can be opened during operation to effect intermittent discharge of a separated heavy component of the supplied mixture, a paring chamber communicating with the separating chamber being formed near the rotor axis, and stationary paring means (preferably a so-called paring disc) extending into said paring chamber for discharging therefrom through its paring channels the liquid which has been separated from the mixture supplied to the rotor, a passage being arranged between the interior of the rotor and the surrounding atmosphere for venting of gas.

Centrifugal separators of this type have previously not been usable in cases where the centrifuged liquid must be substantially totally protected from being mixed with air. It has been found that liquid separated in such a centrifugal separator and then discharged therefrom by the paring means has a substantially larger content of oxygen than the mixture originally supplied to the centrifugal separator.

In spite of attempts to provide the rotor, during its operation, with liquid seals between the atmosphere surrounding the rotor and said paring means, and also between the interior of the rotor and said paring means, the undesired effect of the paring means in causing air to mix with the centrifuged liquid has not been avoided. An arrangement of liquid seals of this kind is previously known, for instance, from German Pat. No. 657,473. An arrangement intended to operate substantially in the same manner is known from Swedish Pat. No. 94,352. Since arrangements of the kind described in these two patents have not given the desired result, in some cases (as in the separation of cream from milk, where the lack of economically sound alternatives makes it necessary to use centrifugal separators for the separating operations in spite of the sensitivity of the liquids to mixing with air) the paring means have been replaced by an arrangement intended to make the interior of the centrifugal rotor completely closed or sealed. In an arrangement of this kind, the separated liquid is discharged from the centrifugal rotor by an overpressure of the liquid supplied to the centrifugal rotor.

In addition to the fact that difficult sealing problems arise in connection with an arrangement of this kind, not even this arrangement has completely solved the problem of mixing centrifuged liquids with air.

The principal object of the present invention is to solve the problem of mixing air with liquid centrifuged in centrifugal separators of the type first described above. The invention is based on the discovery that the mixing of air into the liquid, in centrifugal separators of this type, occurs substantially in connection with the opening of the peripheral outlets of the centrifugal rotor.

The invention is characterized for this purpose by an arrangement comprising an annular partition which is connected with the rotor body and situated between the separating chamber and the paring chamber and which admits, under normal operation, flow of liquid from the separating chamber to the paring chamber but which extends so far inwardly towards the axis of the rotor that when the liquid surface in the separating chamber moves radially outwards, as a consequence of opening of the rotor's peripheral outlets, it prevents liquid within the paring chamber from flowing back to the separating chamber. The arrangement further comprises a first annular, stationary disc arranged coaxially with the rotor and extending into the paring chamber, between said partition and the openings of the paring channels in the paring chamber, to a level radially outside the innermost part of the partition, so that when the rotor's peripheral outlets are opened during operation, a liquid seal is maintained between the separating chamber and the openings of the paring channels in the paring chamber. The arrangement also includes means (known per se) comprising a second annular stationary disc for forming, during the operation of the rotor, a liquid seal between the atmosphere surrounding the rotor and the openings of the paring channels in the paring chamber.

The invention thus relates to an arrangement for preventing air from passing into the paring channels from the atmosphere surrounding the rotor, as well as from the interior of the rotor, when the liquid level within the rotor moves radially outwards incident to opening of the rotor's peripheral outlets. If an arrangement of this kind is not used, as has been the case heretofore in connection with centrifugal separators of the type involved here, movements of the liquid level radially outwards in the rotor, due to occasional opening of the peripheral outlets, will cause the paring channels and a part of the stationary outlet conduit to be emptied of liquid and filled with air. When liquid is again discharged through the paring channels after refilling of the rotor, air which has passed into the paring channels and into the outlet conduit will be entrained by the liquid and effectively mixed therewith.

By the present invention, it is possible to use centrifugal separators of the above-described type in connection with the production of wine. Wine is a liquid which is extremely sensitive to aeration.

According to a preferred embodiment of the invention, the above-mentioned first annular stationary disc extends radially outside the openings of the paring channels in the paring chamber. This eliminates the need for a further annular partition within the rotor for forming a liquid seal between the paring chamber and the separating chamber, when the liquid level in the latter moves radially outwards. Correspondingly, special arrangements are avoided for forming a liquid seal between the paring chamber and the atmosphere surrounding the rotor, if the second annular stationary disc extends within the paring chamber to a lever radially outside the openings of the paring channels therein.

It is understood that in the arrangement according to the invention, the paring means and the two annular stationary discs are interconnected in a way such that no other connection is present between, on one side, the openings of the paring channels within the paring chamber and, on the other side, the atmosphere surrounding the rotor and the interior of the rotor, respectively, than through the two liquid seals obtained by means of the annular discs.

Figure 2:
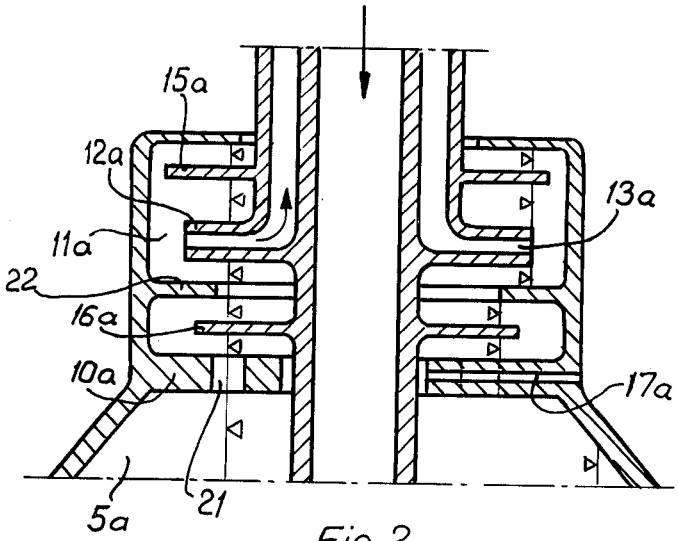
Figure 3:
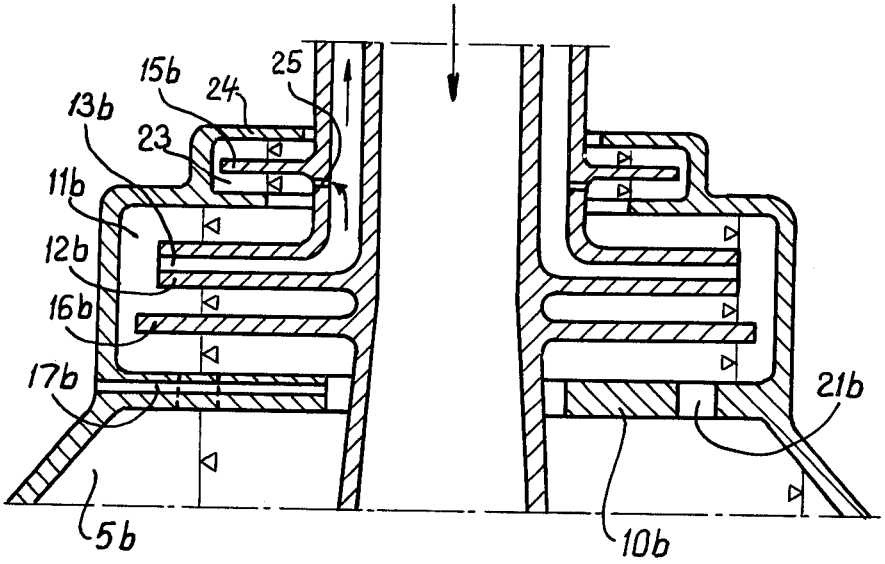

The invention is described in more detail below with reference to the accompanying drawings, in which FIG. 1 is a vertical sectional view of part of a centrifugal separator embodying the invention, and FIGS. 2 and 3 are similar views of alternative embodiments of the invention.

In FIG. 1, a centrifuge rotor comprises an upper part 1 and a lower part 2, which parts are held together by a locking ring 3. The centrifuge rotor is surrounded by a stationary casing 4. Within the centrifuge rotor is a separating chamber 5 containing a so-called disc set 6. At its periphery, the rotor body has a number of discharge openings 7 which can be put into communication with the separating chamber by displacement of an axially movable valve member 8. The valve member 8 is axially movable in a known manner during the operation of the rotor, so that all or a part of the separating chamber's content of sludge and possibly liquid may be discharged from the separating chamber, when desired.

By means of a cap 9 and a partition 10 extending radially inwards from the upper part 1 of the rotor, there is defined in the upper part of the rotor a so-called paring chamber 11. Into the paring chamber 11 extends a stationary paring disc 12, the paring channels 13 of which thus open into the paring chamber. The paring disc is supported by the stationary casing 4, which also supports a pipe 14 communicating with the inlet conduit (not shown) of the centrifugal separator for admitting the mixture to be centrifuged in the rotor. The stationary paring disc 12 supports at its periphery a first annular disc 15 consititutiing an enlargement of the upper wall of the paring disc, and a second annular disc 16 constituting an enlargement of the lower wall of the paring disc. Both of these annular discs 15 and 16 extend into the paring chamber 11, on the respective sides of the openings of the paring channels 13, to a level radially outside those openings. Extending axially through the paring disc 12 is a sleeve 17 which forms a passage between the interior of the rotor and the atmosphere surrounding the rotor.

In the drawing, numeral 18 designates the stationary outlet conduit for liquid separated within the rotor of the centrifuge. Numeral 19 designates the drive shaft of the centrifuge rotor, and numeral 20 designates a conical wall which rotates with the rotor and which separates the separating chamber 5 of the rotor from a central chamber into which the stationary inlet pipe 14 opens.

In the operation of the centrifuge shown in FIG. 1, as long as the peripheral outlets 7 of the rotor are kept closed by means of the axially movable valve member 8, liquid entering through the inlet pipe 14 flows through the separating chamber 5 and the disc set 6 situated therein to the paring chamber 11. Separated liquid is then discharged continuously through the paring channels 13 of the paring disc 12, whereas a separated heavy component of the mixture supplied to the rotor, such as sludge, is collected in the radially outermost part of the separating chamber 5. The liquid level will be situated as indicated by three small triangles at the left-hand part of FIG. 1.

After a period of centrifugation, the peripheral outlets 7 are opened for a short interval to discharge the separated heavy component. The liquid surface within the separating chamber 5 of the rotor then moves rapidly radially outward to a level indicated at the right-hand part of FIG. 1. There the liquid level will remain when the peripheral outlets 7 are closed again, after which it will slowly move radially inward to its original level as new mixture is supplied through the inlet pipe 14. The flow of liquid through the inlet pipe 14 is not interrupted while the peripheral outlets 7 are open, but the flow is insufficient to maintain the liquid level within the rotor at the level shown at the left in FIG. 1.

When the liquid surface in the separating chamber 5 moves radially outwards, some liquid remains within the paring chamber 11. The partition 10 prevents this part of the liquid from flowing back to the separating chamber 5. When the flow of liquid from the separating chamber 5 to the paring chamber 11 ceases, the paring disc 12 starts to empty the paring chamber 11 of liquid. The liquid surface in the paring chamber 11 then moves radially outwards but remains at the level of the openings of the paring channels 13 in the paring chamber. This level is indicated by two small triangles at the right-hand part of FIG. 1. As can be seen from FIG. 1, the two annular discs 15 and 16 still extend on the respective sides of the paring channels 13 radially outside the liquid level within the paring chamber 11 and thus participate in the formation of liquid seals between the openings of the paring channels 13 in the paring chamber 11 and the interior of the rotor, and between those channel openings and the atmosphere surrounding the rotor. Air is thus prevented from passing into the paring channels 13. When the liquid surface in the separating chamber 5 gradually returns to its original level, the liquid level within the paring chamber 11 will also return to its original level.

According to the modified embodiment of the invention shown in FIG. 2, the paring chamber 11*a* has a lower confining wall formed by a partition 10*a* connected with the rotor. This partition has a number of through-going holes 21 arranged in a ring around the axis of the rotor and also has a radial channel 17*a* forming a passage between the interior of the rotor and the atmosphere surrounding the rotor. An annular stationary disc 15*a* situated above the paring disc 12*a* operates essentially in the same way as the annular disc 15 in FIG. 1, whereas an annular stationary disc 16*a* situated below the paring disc 12*a* operates in a somewhat different way than the disc 16 in FIG. 1.

The lower annular disc 16*a* in FIG. 2 does not extend as far radially outward as the corresponding disc 16 in FIG. 1. As can be seen from FIG. 2, it is true that the disc 16*a* extends radially outside the holes 21 in the partition 10*a* between the paring chamber 11*a* and the separating chamber 5*a*, but it does not extend to the level of the openings of the paring channels 13*a* in the paring chamber 11*a*. To obtain a liquid seal with this arrangement, it is necessary to provide the rotor body internally with a further partition 22 situated between the paring disc 12*a* and the first-mentioned partition 10*a*. The further partition 22 extends radially inward within the paring chamber 11*a*, between the paring disc 12*a* and the stationary disc 16*a*, to a level radially inside the openings of the paring channels 13*a*, in the paring chamber 11*a* as well as the outermost edge of the stationary disc 16*a*.

The left-hand part of FIG. 2 shows the positions of the liquid surfaces when the peripheral outlets of the rotor are closed, and the right-hand part of FIG. 2 shows the positions of these liquid surfaces when the peripheral outlets have been opened.

In the FIG. 3 embodiment of the invention, a lower annular stationary disc 16*b* corresponds in its function exactly to the disc 16 in FIG. 1, and an upper annular stationary disc 15*b* extends into a chamber 23 separated from the paring chamber 11*b*. The separate chamber 23 is formed by an extra wall 24 of the rotor body. A throttled opening 25 is provided in one of the walls forming the outlet channel for liquid discharged through the paring channels 13*b*; and through this opening 25 the separate chamber 23 is continuously supplied with a small amount of liquid, so that a liquid seal between the paring chamber 11*b* and the atmosphere surrounding the rotor is constantly maintained by means of the upper annular stationary disc 15*b*.

The left-hand part of FIG. 3 shows the positions of the liquid surfaces when the peripheral outlets of the rotor are closed, and the right-hand part of FIG. 3 shows the positions of these liquid surfaces when the peripheral outlets have been opened.

In the embodiments according to FIGS. 2 and 3, only the part of the partition 10*a* (10*b*) situated radially outside the holes 21 (21*b*) constitutes an obstacle to return flow of liquid from the paring chamber 11*a* (11*b*) to the separating chamber 5*a* (5*b*). In these two embodiments, it is believed that in practice the paring disc will create a partial vacuum in the gas-filled space between the two annular stationary discs, with the result that the liquid surfaces facing this space will be situated somewhat closer to the axis of the rotor than the rest of the liquid surfaces (not shown), but this does not affect the inventive concept.

I claim:

1. In combination with a centrifugal separator including a rotor forming a separating chamber and having a central inlet for a mixture to be centrifuged, the rotor also having normally closed peripheral outlets adapted to be opened intermittently during rotation of the rotor to effect intermittent discharge of a separated heavy component from the separating chamber, the rotor also forming a paring chamber located near the rotor axis and communicating with the separating chamber, and stationary paring means extending into the paring chamber and having a paring channel for discharging liquid separated from said mixture, an arrangement for preventing air from passing into said paring channel when the liquid level within the rotor moves radially outward due to opening of said peripheral outlets, said arrangement comprising an annular partition connected with the rotor and located between the separating chamber and the paring chamber, said partition allowing liquid flow, during normal operation of the rotor, from the separating chamber to the paring chamber but extending so far inwardly toward the rotor axis that upon movement of the liquid level in the separating chamber radially outward due to opening of said peripheral outlets, said partition prevents some liquid in the paring chamber from flowing back to the separating chamber, said arangement also comprising a first annular stationary disc coaxial with the rotor and extending into the paring chamber to a level radially outside the innermost part of the partition, said disc being arranged to maintain a liquid seal between the separating chamber and the opening of said paring channel into the paring chamber when said peripheral outlets are opened during rotation of the rotor, and means including a second annular stationary disc operable during rotation of the rotor to form a liquid seal between said opening of the paring channel and the atmosphere surrounding the rotor, there being a gas-venting passage between the interior of the rotor and the surrounding atmosphere, said passage affording unobstructed flow of air in both directions through the passage.

2. A centrifugal separator according to claim 1, in which said first annular stationary disc extends radially outside the opening of said paring channel within the paring chamber.

3. A centrifugal separator according to claim 1, in which said second annular stationary disc extends into the paring chamber to a level radially outside the opening of said paring channel therein.

4. A centrifugal separator according to claim 1, in which said paring means include paring disc, both of said annular stationary discs being affixed to the paring disc.

5. A centrifugal separator according to claim 1, in which each of said first and second annular stationary discs extends radially outside the opening of said paring channel within the paring chamber.

6. A centrifugal separator according to claim 1, comprising also a stationary feed pipe disposed axially of the rotor for delivering said mixture to said central inlet of the rotor, said first annular stationary disc extending continuously from said feed pipe radially outward to said level radially outside the innermost part of the partition.

7. A centrifuge according to claim 6, in which said first disc extends radially outside the opening of said paring channel within the paring chamber.

* * * * *